US008920123B2

(12) United States Patent
Lee

(10) Patent No.: US 8,920,123 B2
(45) Date of Patent: Dec. 30, 2014

(54) TURBINE BLADE WITH INTEGRATED SERPENTINE AND AXIAL TIP COOLING CIRCUITS

(71) Applicant: Ching-Pang Lee, Cincinnati, OH (US)

(72) Inventor: Ching-Pang Lee, Cincinnati, OH (US)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 13/714,518

(22) Filed: Dec. 14, 2012

(65) Prior Publication Data

US 2014/0169962 A1 Jun. 19, 2014

(51) Int. Cl.
*F01D 5/18* (2006.01)
*F01D 5/20* (2006.01)

(52) U.S. Cl.
CPC . *F01D 5/187* (2013.01); *F01D 5/20* (2013.01)
USPC ..... 416/97 R; 416/92

(58) Field of Classification Search
CPC ..... F01D 5/187; F01D 5/20
USPC ..... 415/115; 416/95, 96 R, 97 R, 90 R, 92, 416/232
See application file for complete search history.

(56) References Cited

U.S. PATENT DOCUMENTS

| | | | | |
|---|---|---|---|---|
| 4,474,532 | A * | 10/1984 | Pazder | 416/97 R |
| 5,403,159 | A * | 4/1995 | Green et al. | 416/97 R |
| 5,695,322 | A * | 12/1997 | Jacobson et al. | 416/97 R |
| 5,902,093 | A | 5/1999 | Liotta et al. | |
| 5,931,638 | A | 8/1999 | Krause et al. | |
| 6,164,914 | A | 12/2000 | Correia et al. | |
| 6,331,098 | B1 * | 12/2001 | Lee | 416/97 R |
| 6,595,748 | B2 * | 7/2003 | Flodman et al. | 416/97 R |
| 6,602,052 | B2 * | 8/2003 | Liang | 416/97 R |
| 6,832,889 | B1 | 12/2004 | Lee et al. | |
| 6,916,150 | B2 | 7/2005 | Liang | |
| 6,932,573 | B2 | 8/2005 | Liang | |
| 7,059,825 | B2 | 6/2006 | Magowan et al. | |
| 7,097,419 | B2 | 8/2006 | Lee et al. | |
| 7,104,757 | B2 | 9/2006 | Gross | |
| 7,413,403 | B2 | 8/2008 | Cunha et al. | |
| 7,537,431 | B1 | 5/2009 | Liang | |
| 7,780,415 | B2 * | 8/2010 | Liang | 416/97 R |
| 7,967,563 | B1 | 6/2011 | Liang | |
| 8,025,482 | B1 | 9/2011 | Liang | |
| 2005/0111979 | A1 * | 5/2005 | Liang | 416/97 R |
| 2005/0281671 | A1 | 12/2005 | Liang | |
| 2006/0153680 | A1 | 7/2006 | Liang | |
| 2009/0068021 | A1 | 3/2009 | Liang | |
| 2010/0047057 | A1 * | 2/2010 | Kopmels | 415/115 |
| 2010/0290921 | A1 | 11/2010 | Mhetras | |

* cited by examiner

*Primary Examiner* — Ned Landrum
*Assistant Examiner* — Justin Seabe

(57) ABSTRACT

An air cooled turbine blade including leading and trailing edges, and pressure and suction side walls extending between the leading and trailing edges. Leading and trailing edge cooling circuits extend spanwise adjacent to the leading and trailing edges, respectively. A forward flow mid-section serpentine cooling circuit extends spanwise and is located between the leading and trailing edge cooling circuits. An axial tip cooling circuit extends in the chordal direction and is located between a tip cap of the blade and the serpentine cooling circuit at an outer end of the serpentine cooling circuit. The axial tip cooling circuit has a forward end receiving cooling air from a final channel of the serpentine cooling circuit and discharges the cooling air adjacent to the trailing edge.

14 Claims, 4 Drawing Sheets

TURBINE BLADE WITH INTEGRATED SERPENTINE AND AXIAL TIP COOLING CIRCUITS

FIELD OF THE INVENTION

This invention is directed generally to turbine blades and, more particularly, to a turbine blade having cooling circuits for conducting cooling air through an airfoil of the blade.

BACKGROUND OF THE INVENTION

A conventional gas turbine engine includes a compressor, a combustor and a turbine. The compressor compresses ambient air which is supplied to the combustor where the compressed air is combined with a fuel and ignites the mixture, creating combustion products forming a hot working gas. The working gas is supplied to the turbine where the gas passes through a plurality of paired rows of stationary vanes and rotating blades. The rotating blades are coupled to a shaft and disc assembly. As the working gas expands through the turbine, the working gas causes the blades, and therefore the shaft and disc assembly, to rotate.

As a result of the exposure of the turbine blades to the hot working gases, the turbine blades must be made of materials capable of withstanding such high temperatures. In addition, turbine blades often contain cooling systems for prolonging the life of the blades and reducing the likelihood of failure as a result of excessive temperatures.

Typically, turbine blades comprise a root, a platform and an airfoil that extends outwardly from the platform. The airfoil is ordinarily composed of a tip, a leading edge and a trailing edge. Most blades typically contain internal cooling channels forming a cooling system. The cooling channels in the blades may receive cooling air from the compressor of the turbine engine and pass the air through the blade.

SUMMARY OF THE INVENTION

In accordance with an aspect of the invention, an air cooled turbine blade is provided comprising an airfoil having a leading edge and a trailing edge, and a pressure side wall and a suction side wall. The pressure and suction side walls extend in a chordal direction between the leading and trailing edges and extend spanwise between a blade root and a tip of the airfoil. A leading edge cooling circuit extends spanwise adjacent to the leading edge, and a trailing edge cooling circuit extends spanwise adjacent to the trailing edge. A mid-section serpentine cooling circuit extends spanwise and is located between the leading edge cooling circuit and the trailing edge cooling circuit for channeling air in a forward direction extending from the trailing edge toward the leading edge. The serpentine cooling circuit includes a first channel and a final channel, the first channel receiving cooling air from a first channel root passage. An axial tip cooling circuit extends in the chordal direction and is located between a tip cap and the serpentine cooling circuit at an outer end of the first channel. The axial tip cooling circuit has a forward end receiving cooling air from the final channel of the serpentine cooling circuit and discharges the cooling air adjacent to the trailing edge.

The final channel of the serpentine cooling circuit may be an outwardly flowing channel that extends to the tip cap and connects to the forward end of the axial tip cooling circuit at a bend. The serpentine cooling circuit may include at least one intermediate channel between the first and final channels, and the cooling flow may pass through each of the first, intermediate and final channels prior to entering the axial tip cooling circuit at the bend. Adjacent channels may be separated by legs extending spanwise and extending from the pressure side wall to the suction side wall, and the leading edge cooling circuit and the final channel of the serpentine circuit may be separated by a common leg therebetween.

A leading edge root passage may provide cooling air to the leading edge cooling circuit and a trailing edge root passage may provide cooling air to the trailing edge cooling circuit, wherein the leading edge cooling circuit directs cooling air to the leading edge and the trailing edge cooling circuit provides cooling air exiting the airfoil at a plurality of trailing edge exit passages.

The axial tip cooling circuit may be defined as a continuous cavity extending from the pressure side wall to the suction side wall between the tip cap and a cavity floor extending in an aft direction from the forward end of the axial tip cooling circuit to a location adjacent to the trailing edge. The cavity floor may define an outer flow boundary for the serpentine cooling circuit at the outer end of the first channel and for the trailing edge cooling circuit.

Pressure and suction wall corners may be defined within the axial tip cooling circuit at junctions of the tip cap with the respective pressure and suction side walls, and the tip cap may be defined by opposing side portions extending inwardly from the pressure and suction wall corners toward the cavity floor where the axial tip cooling circuit has a minimum dimension in the spanwise direction. Rib-like turbulators may extend from inner surfaces of the pressure and suction side walls within the axial tip cooling circuit, the turbulators angled in the spanwise and aft directions, with respect to the cavity floor, to create a turbulent flow of the cooling air in the axial tip cooling circuit radially outward toward the tip cap. The turbulators may be angled outward from the cavity floor at an angle within a range from about 30 degrees to about 45 degrees.

In accordance with another aspect of the invention, a process is provided for cooling a turbine blade used in a gas turbine engine, the turbine blade including an inward located blade root and an airfoil having an outward located tip, the airfoil including a leading edge and a trailing edge with a plurality of trailing edge exit passages to discharge cooling air from the airfoil. The process comprises supplying cooling air to the airfoil via the blade root; passing a portion of the cooling air through a leading edge cooling circuit to cool the leading edge of the airfoil; passing a portion of the cooling air through a trailing edge cooling circuit to exit the airfoil through the plurality of exit passages; passing a portion of the cooling air through a forward flowing serpentine cooling circuit between the leading edge cooling circuit and the trailing edge cooling circuit; and passing the cooling air from a forward end of the serpentine cooling circuit to flow axially within an axial tip cooling circuit toward the trailing edge to provide cooling to a tip cap located at the tip of the airfoil.

The serpentine cooling circuit may include a first channel, at least one intermediate channel and a final channel, wherein the final channel includes an outer end adjacent to the tip cap where the cooling air may pass from the serpentine cooling circuit to the axial tip cooling circuit. Cooling air from the serpentine cooling circuit may pass along an inner surface of the tip cap, within the axial tip cooling circuit, from a forward location adjacent to the leading edge cooling circuit to a rearward location where it exits the airfoil adjacent to the trailing edge of the airfoil. The portion of cooling air passing through the serpentine cooling circuit may be supplied via the blade root to the first channel of the serpentine cooling circuit.

An additional portion of the cooling air may be supplied directly to the final channel of the serpentine cooling circuit via the blade root.

A greater amount of air may be directed within the axial tip cooling circuit toward portions of the axial tip cooling circuit adjacent to side walls of the airfoil than is provided to a chordal center of the axial tip cooling circuit.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
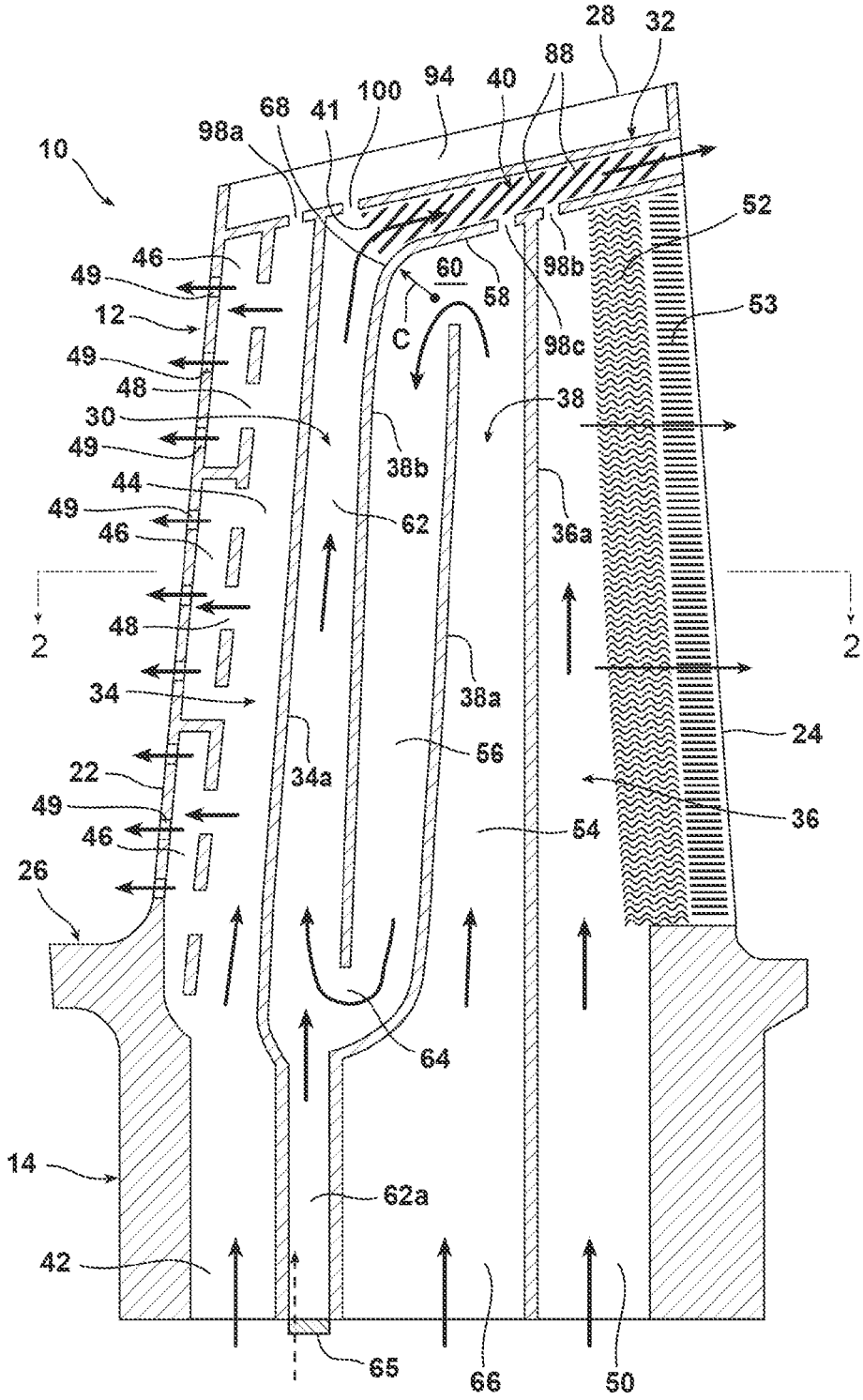
FIG. 1 is a cross-sectional view taken along a chordal center of a turbine blade illustrating aspects of the invention.

Referring to FIG. 1, in accordance with an aspect of the invention, an air cooled turbine blade 10 for a gas turbine engine is illustrated. The blade 10 includes an airfoil 12 and a root 14 which is used to conventionally secure the blade 10 to a rotor disk of the engine for supporting the blade 10 in the hot working gas flow path of the turbine where a hot working gas exerts motive forces on the surfaces thereof.

Figure 2:
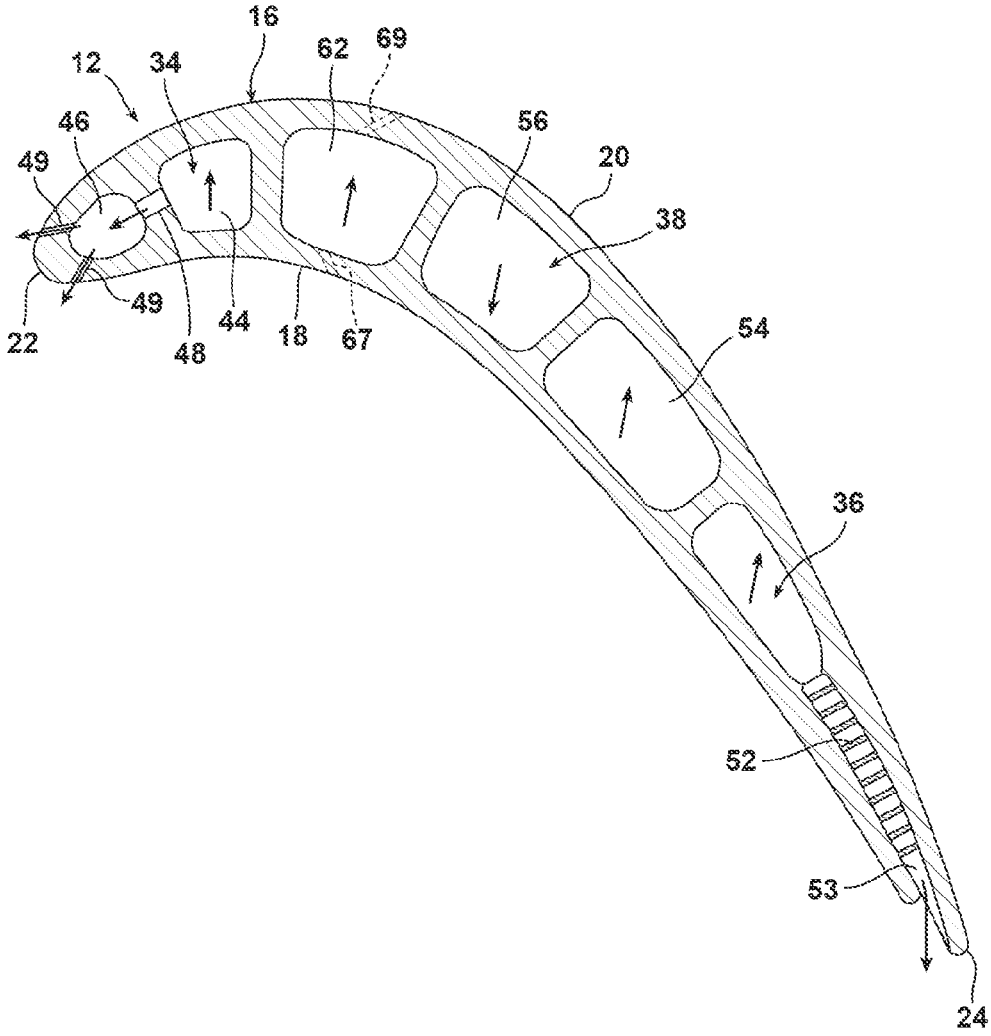
FIG. 2 is a cross-sectional view taken along line 2-2 in FIG. 1.

As is further seen in FIG. 2, the airfoil 12 has an outer wall 16 comprising a generally concave pressure side wall 18 and a generally convex suction side wall 20. The pressure and suction side walls 18, 20 are joined together along an upstream leading edge 22 and a downstream trailing edge 24. The leading and trailing edges 22, 24 are spaced axially or chordally from each other. The airfoil 12, as defined by the pressure and suction side walls 18, 20, extends radially along the spanwise or radial direction of the blade 10 from a radially inner blade platform 26 to a radially outer blade tip 28, and extends chordally between the leading and trailing edges 22, 24. The root 14 extends radially inward from the blade platform 26.

Referring to FIG. 1, a cavity 30 is defined within the airfoil 12 between the pressure and suction side walls 18, 20. In accordance with an aspect of the invention, a plurality of cooling circuits are provided within the cavity 30 for providing cooling to the outer wall 16 and a tip cap 32 of the blade 10. In particular, contained within the cavity 30 is a leading edge cooling circuit 34, a trailing edge cooling circuit 36, a mid-section serpentine cooling circuit 38 and an axial tip cooling circuit 40.

Figure 4:
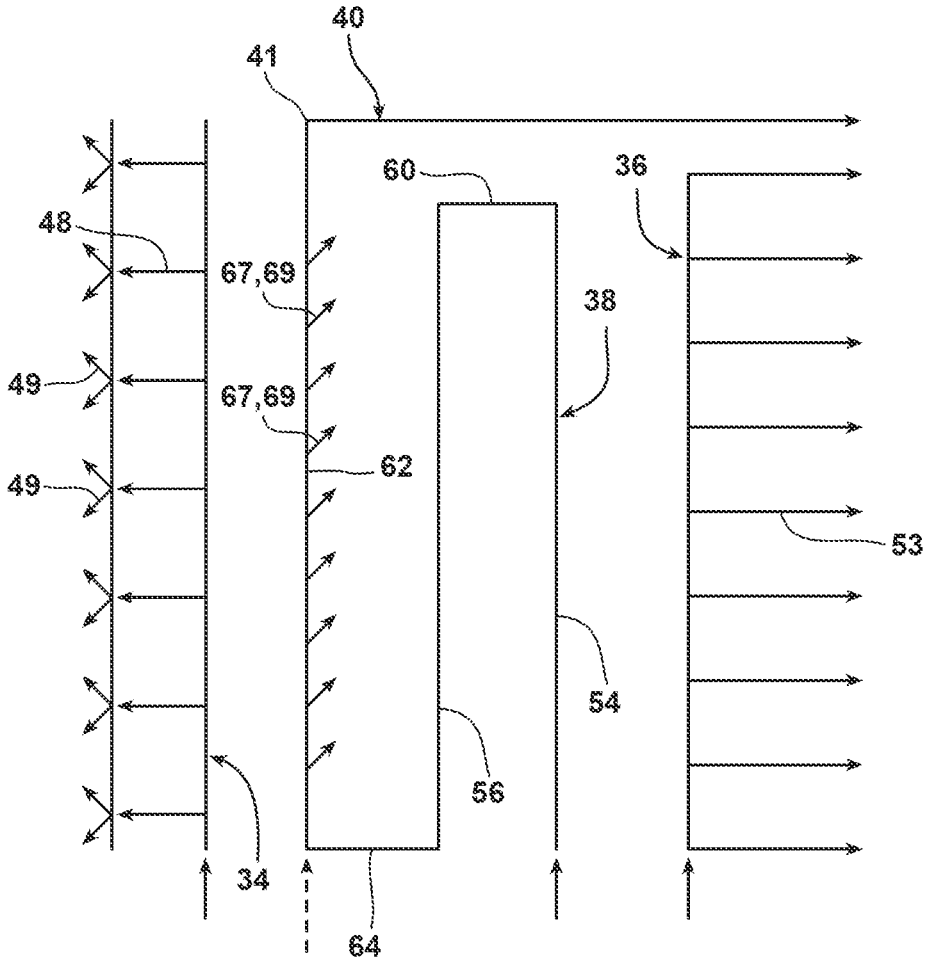
FIG. 4 is a flow diagram of cooling air flow through cooling circuits illustrating aspects of the invention.

The leading edge cooling circuit 34 extends spanwise within the cavity 30 to the tip cap 32 adjacent to the leading edge 22, and receives cooling air supplied through a leading edge root passage 42, such as may be provided as cooling air bled from a compressor of the engine and channeled to the rotor disk in a conventional manner. The leading edge cooling circuit 34 includes a main channel 44 and is illustrated as including a plurality of leading edge plenums 46 fed by a plurality of cross holes 48 communicating with the main channel 44. Most of the air from the leading edge plenums 46 may be bled off through a showerhead arrangement of film cooling holes 49, as seen in FIGS. 1, 2 and 4. The film cooling holes 49 provide a film cooling flow of the cooling air to the leading edge 22 of the airfoil 12.

The trailing edge cooling circuit 36 extends spanwise within the cavity 30 to the axial tip cooling circuit 40 adjacent to the trailing edge 24, and receives cooling air supplied through a trailing edge root passage 50. The trailing edge cooling circuit 36 includes a plurality of trailing edge exit passages 52, illustrated herein as a plurality of zig-zag passages configured to provide convective heat transfer for cooling the pressure and suction side walls 18, 20 adjacent to the trailing edge 24. The cooling air passing though the exit passages 52 is discharged through discharge slots 53 to provide film cooling at the trailing edge 24 of the airfoil 12.

The mid-section serpentine cooling circuit 38 extends spanwise within the cavity 30 and is located between the leading edge cooling circuit 34 and the trailing edge cooling circuit 36 for channeling cooling air in a forward direction extending from the trailing edge 24 toward the leading edge 22. The serpentine cooling circuit 38 includes a first channel 54, an intermediate channel 56 connected to the first channel 54 adjacent to a cavity floor 58 by an outer axial passage 60, and a final channel 62 connected to the intermediate channel 56 by an inner axial passage 64. Cooling air enters the first channel 54 through a first channel root passage 66 and flows radially outward toward the cavity floor 58.

The axial tip cooling circuit 40 extends in the chordal direction and is located between the tip cap 32 and the serpentine cooling circuit 38 at an outer end of the serpentine cooling circuit 38, as defined by the first, intermediate and final channels 54, 56, 62. The outer end of the first and intermediate channels 54, 56 is defined by the cavity floor 58 extending between the pressure and suction side walls 18, 20, and the outer end of the final channel 62 is defined by the tip cap 32 and is located at an area coinciding with a forward end 41 of the axial tip cooling circuit 40. The axial tip cooling circuit 40 extends continuously from the forward end 41, where cooling air is received from the final channel 62 of the serpentine cooling circuit 38, to the trailing edge 24 where the cooling air is discharged from the axial tip cooling circuit 40.

The adjacent first and intermediate channels 54, 56 are separated by a first partition or leg 38*a* spanning between the pressure and suction side walls 18, 20, and a second partition or leg 38*b* spanning between the pressure and suction side walls 18, 20 separates the adjacent intermediate and final channels 56, 62. The legs 38*a*, 38*b* extend outward from an inner location, such as adjacent to the platform 26 and/or root 14. The first leg 38*a* extends to the location of the first axial passage 60, and the second leg 38*b* extends from the location of the second axial passage 64 to the cavity floor 58 wherein a junction between the second leg 38*b* and a forward end of the cavity floor 58 is defined by a bend 68 i.e., a gradual or curved transition, having an arc of curvature C wherein the arc of curvature is preferably greater than about half an axial width of the intermediate passage 56. Hence, the serpentine cooling circuit 38 and the axial tip cooling circuit 40 may be considered as integral, or a continuous circuit, for cooling the mid-section and tip of the blade 10.

The final channel 62 of the serpentine cooling circuit 38 and the main channel 44 of the leading edge cooling circuit 34 are separated by a partition or leg 34*a* spanning between the pressure and suction side walls 18, 20 wherein the leg 34*a* is common to both the leading edge cooling circuit 34 and the serpentine cooling circuit 38. The first channel 54 of the serpentine cooling circuit 38 and the trailing edge cooling circuit 36 are separated by a partition or leg 36*a* spanning between the pressure and suction side walls 18, 20 wherein the leg 36*a* is common to both the trailing edge cooling circuit 36 and the serpentine cooling circuit 38. Hence, the serpentine cooling circuit 38 spans axially between the leading edge cooling circuit 34 and the trailing edge cooling circuit 36. Additionally, substantially all of the cooling air supplied to the serpentine cooling circuit 38 through the first channel root passage 66 flows through the serpentine cooling circuit 38 prior to entering the axial tip cooling circuit 40.

It should be understood that a limited amount of the cooling air passing through the final channel 62 may be bled off to provide film cooling to the pressure side wall 18 and/or to the suction side wall 20. For example, as seen in FIG. 2, a row of pressure side film cooling holes 67 and/or a row of suction side film cooling holes 69 may optionally be provided for providing a film cooling flow of a portion of the air from the final channel 62.

It may be noted that the final channel 62 is illustrated with a final channel extension 62*a* extending into the root 14, and may be provided to provide support for a ceramic core during manufacture of the blade 10. A metering plate 65 may be welded to cover the opening at the radially inner end of the channel extension 62*a* to prevent or limit flow of cooling air into the channel extension 62*a*. For example, the metering plate 65 may permit a limited amount of cooling air to pass from the rotor disk into the channel extension 62*a* as refresher air for the cooling air passing through the final channel 62 of the serpentine cooling circuit 38.

Figure 3:
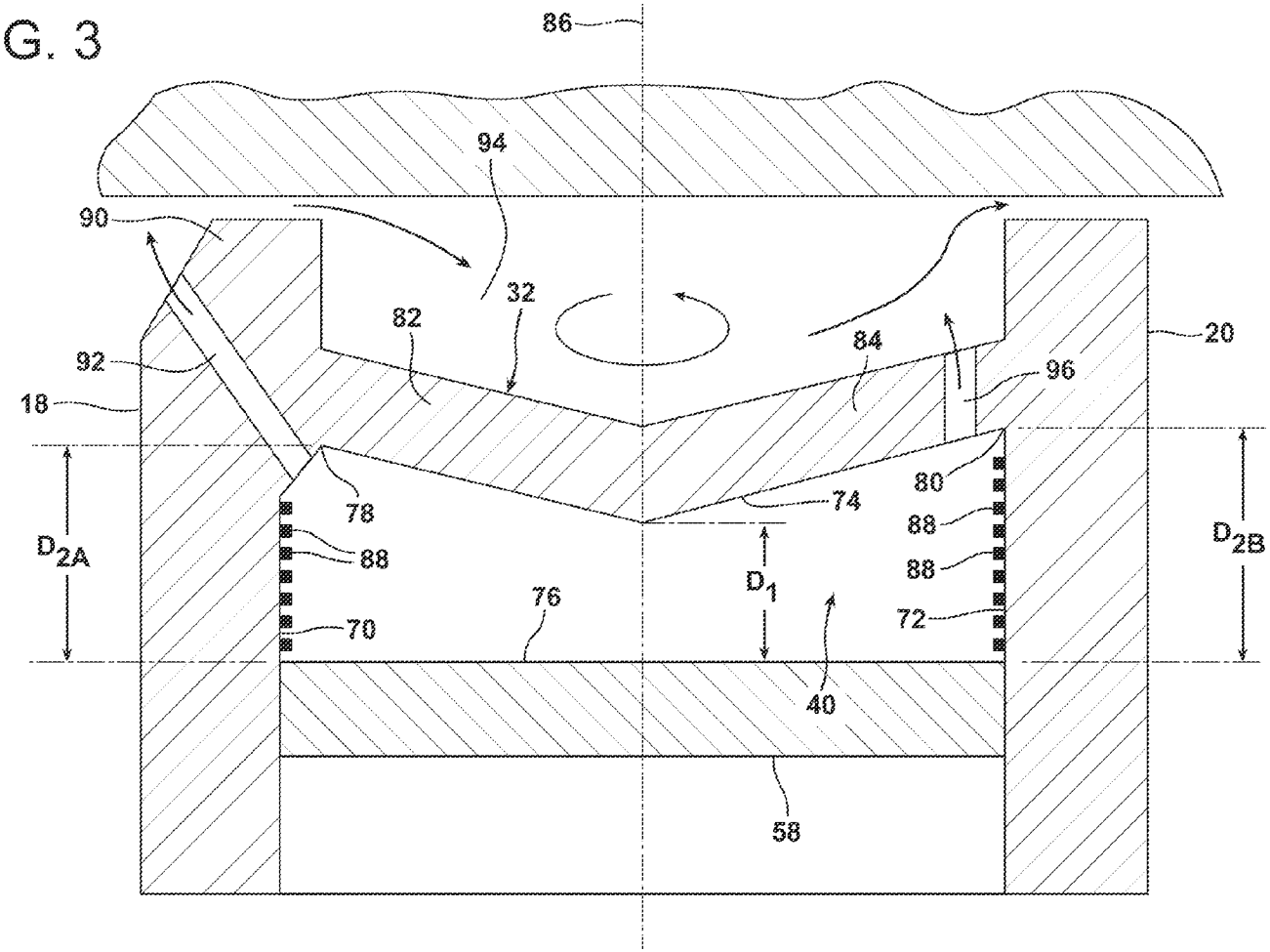
FIG. 3 is a cross-sectional view of an outer portion of the turbine blade taken transverse to the chordal direction.

Referring to FIG. 3, the axial tip cooling circuit 40 is defined as a continuous, or unpartitioned, cavity extending between respective inner side wall surfaces 70, 72 of the pressure and suction side walls 18, 20, and extending between an inner tip cap surface 74 and a radially outer surface 76 of the cavity floor 58, which surface 76 has a generally planar configuration extending between the inner side wall surfaces 70, 72.

A pressure wall corner 78 is defined at a junction between the inner tip cap surface 74 and the inner side wall surface 70, and a suction wall corner 80 is defined at a junction between the tip cap surface 74 and the inner side wall surface 72. The tip cap 32 is defined by opposing, generally planar side portions 82, 84 extending inwardly toward the chordal center 86 of the airfoil 12 from the pressure side wall 18 and the suction side wall 20, respectively. The inward extension of the side portions 82, 84 includes a radial inward angling of each of the side portions 82, 84 toward the cavity floor 58. In the illustrated embodiment, the tip cap 32 is formed with a generally V-shaped cross-section. However, it should be understood that the side portions 82, 84 may meet at a radiused or curved junction.

A minimum distance $D_1$ between the inner tip cap surface 74 and the radially outer surface 76 of the cavity floor 58, in the spanwise direction, is defined at the junction between the side portions 82, 84, and maximum or greater distances $D_{2A}$, $D_{2B}$ between the inner tip cap surface 74 and the radially outer surface 76 of the cavity floor 58 are defined at the pressure and suction wall corners 78, 80. Hence, a larger volume of the cooling air passing through the axial tip cooling circuit 40 is directed to flow adjacent to the pressure and suction side walls 18, 20 than will flow along the center 86 of the axial tip cooling circuit 40.

Further, rib-like turbulators 88 extend from the inner side wall surfaces 70, 72 into axial tip cooling circuit 40. As may be seen in FIG. 1, the turbulators 88 are angled in the spanwise and aft directions, with respect to the cavity floor 58, to create a turbulent flow of the cooling air in the axial tip cooling circuit 40 in the radial outward direction toward the tip cap 32. The turbulators 88 may be angled outward from the cavity floor 58 at an angle within a range from about 30 degrees to 45 degrees. Thus, the axial tip cooling circuit 40 is configured to increase the cooling air flow, and consequently the cooling, to the pressure and suction side walls 18, 20 and to the tip cap 32 in the areas adjacent to the corners 78, 80.

It should be noted that the axial tip cooling circuit 40 may provide cooling air to various areas in and around the tip cap 32. For example, the tip cap 32 may include a squealer rail 90, and cooling holes 92 may extend from the axial tip cooling circuit 40 to a location on the pressure side of the squealer rail 90 to provide cooling to the pressure side of the squealer rail 40 where hot gases pass over the squealer rail 90 into a squealer tip cavity 94. Additional holes 96 may be provided, for example, to inject cooling air into the squealer tip cavity 94, such as to provide cooling to the tip cavity 94 and squealer rail 90.

Referring to FIG. 1, one or more dust holes may also be provided associated with outer ends of each of the cooling circuits 34, 36, 38, to permit escape of debris from within the circuits. For example, the leading edge cooling circuit 34 may include dust hole(s) 98*a*, the trailing edge cooling circuit 36 may include dust hole(s) 98*b* and the serpentine cooling circuit 38 may include dust hole(s) 98*c*. Additional holes may be provided, such as is illustrated by hole 100 in the tip cap 32, to provide cooling air to the squealer tip cavity 94.

Referring to FIG. 4, a process of cooling the blade 10 includes providing a flow of cooling air from the rotor disk root passages to each of the cooling circuits 34, 36, 38. The cooling air to the leading and trailing edge cooling circuits 34, 36 provides cooling to the leading and trailing edges 22, 24, respectively, and do not have flow communication paths to the other circuits within the airfoil cavity 30. The serpentine cooling circuit 38 provides a continuous forward flow of cooling air through the mid-portion of the airfoil 12, and substantially all of the air passing through the serpentine circuit forms the cooling air supply for the axial tip cooling circuit 40 for providing a cooling air flow along the inner surface 74 of the tip cap 32. That is, all of the air passing through the serpentine cooling circuit 38, except for the limited amount of cooling air that may be bled off through dust holes 98*c* or tip cap cooling holes 100, is directed to flow into the forward end 41 of the axial tip cooling circuit 40.

It should be understood that although the present invention is described with reference to a three-pass serpentine cooling circuit, alternative cooling circuits having additional passes may be provided, such as a cooling circuit having additional intermediate channels. Such alternative serpentine cooling circuits may be configured in a manner similar to the serpentine cooling circuit 38 described herein, with an initial or first channel located adjacent to a trailing edge cooling circuit, and a final channel located adjacent to a leading edge cooling circuit and feeding an axial tip cooling circuit, as is described above.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An air cooled turbine blade comprising:

an airfoil having a leading edge and a trailing edge, and a pressure side wall and a suction side wall, the pressure and suction side walls extend in a chordal direction between the leading and trailing edges and extend spanwise between a blade root and a tip of the airfoil;

a leading edge cooling circuit extending spanwise adjacent to the leading edge;

a trailing edge cooling circuit extending spanwise adjacent to the trailing edge;

a mid-section serpentine cooling circuit extending spanwise and located between the leading edge cooling circuit and the trailing edge cooling circuit for channeling air in a forward direction extending from the trailing edge toward the leading edge, the serpentine cooling circuit including a first channel and a final channel, the first channel receiving cooling air from a first channel root passage;

an axial tip cooling circuit extending in the chordal direction and located between a tip cap and the serpentine cooling circuit at an outer end of the first channel, the axial tip cooling circuit having a forward end receiving cooling air from the final channel of the serpentine cooling circuit and discharging the cooling air adjacent to the trailing edge, wherein the axial tip cooling circuit is defined as a continuous cavity extending from the pressure side wall to the suction side wall between the tip cap and a cavity floor extending in an aft direction from the forward end of the axial tip cooling circuit to a location adjacent to the trailing edge;

a squealer rail extending radially outward from the tip cap to a radially outer blade tip at the pressure and suction side walls; and wherein pressure and suction wall corners are defined within the axel tip cooling circuit at junctions of the tip cap with the respective pressure and suction side walls, and the tip cap is defined by opposing side portions extending inwardly from the pressure and suction wall corners toward the cavity floor, the opposing side portions each comprising a continuous radial inward angling to form a junction of the opposing side portions at a chordal center of the airfoil, wherein the axial tip cooling circuit has a minimum dimension in the spanwise direction at the chordal center of the airfoil.

2. The turbine blade of claim 1, wherein the final channel of the serpentine cooling circuit is an outwardly flowing channel that extends to the tip cap and connects to the forward end of the axial tip cooling circuit at a bend.

3. The turbine blade of claim 2, wherein the serpentine cooling circuit includes at least one intermediate channel between the first and final channels, and the cooling flow passes through each of the first, intermediate and final channels prior to entering the axial tip cooling circuit at the bend.

4. The turbine blade of claim 3, wherein adjacent channels are separated by legs extending spanwise and extending from the pressure side wall to the suction side wall, and the leading edge cooling circuit and the final channel of the serpentine circuit are separated by a common leg therebetween.

5. The turbine blade of claim 1, including a leading edge root passage providing cooling air to the leading edge cooling circuit and a trailing edge root passage providing cooling air to the trailing edge cooling circuit, wherein the leading edge cooling circuit directs cooling air to the leading edge and the trailing edge cooling circuit provides cooling air exiting the airfoil at a plurality of trailing edge exit passages.

6. The turbine blade of claim 1, wherein the cavity floor defines an outer flow boundary for the serpentine cooling circuit at the outer end of the first channel and for the trailing edge cooling circuit.

7. The turbine blade of claim 1 including rib-like turbulators extending from inner surfaces of the pressure and suction side walls within the axial tip cooling circuit, the turbulators angled in the spanwise and aft directions, with respect to the cavity floor, to create a turbulent flow of the cooling air in the axial tip cooling circuit radially outward toward the tip cap.

8. The turbine blade of claim 7, wherein the turbulators are angled outward from the cavity floor at an angle within a range from about 30 degrees to about 45 degrees.

9. A process for cooling a turbine blade used in a gas turbine engine, the turbine blade including an inward located blade root and an airfoil having an outward located tip comprising a tip cap located at a radially outer end of the tip, the airfoil including a leading edge and a trailing edge with a plurality of trailing edge exit passages to discharge cooling air from the airfoil, wherein the tip cap further comprises a squealer rail extending radially outward from a junction of an outer tip cap surface with a pressure side wall and a suction side wall, the squealer rail extending chordally from the leading edge to the trailing edge, wherein the tip cap is recessed relative to the squealer rail to define a squealer tip cavity,the process comprising:

supplying cooling air to the airfoil via the blade root;

passing a portion of the cooling air through a leading edge cooling circuit to cool the leading edge of the airfoil;

passing a portion of the cooling air through a trailing edge cooling circuit to exit the airfoil through the plurality of exit passages;

passing a portion of the cooling air through a forward flowing serpentine cooling circuit between the leading edge cooling circuit and the trailing edge cooling circuit;

passing the cooling air from a forward end of the serpentine cooling circuit to flow axially within an axial tip cooling circuit toward the trailing edge to provide cooling to the tip cap; and directing a greater amount air within the axial tip cooling circuit toward portions of the axial cooling circuit adjacent to the pressure and suction side walls of the airfoil than is provided to a chordal center of the axial tip cooling circuit, comprising:

a) providing a reduced spanwise dimension at a chordal center of the airfoil in the axial tip cooling circuit than spanwise dimensions of the axial tip cooling circuit adjacent to the pressure and suction side walls, wherein pressure and suction wall corners are defined within the axial tip cooling circuit at junctions of an inner tip cap surface with the respective pressure and suction side walls and the tip cap is defined by opposing side portions extending inwardly from the pressure and suction wall corners toward the cavity floor, the opposing side portions each comprising a continuous radial inward angling to form a junction of the opposing side portions at the chordal center of the airfoil; and b) providing rib-like turbulators extending from inner surface of the pressure and suction side walls within the axial tip cooling circuit, the turbulators angled radially outward in the spanwise and aft directions, with respect to the cavity floor, to create a flow of the cooling air in the axial tip cooling circuit radially outward to corners defined at junctions between the pressure and suction walls and the tip cap.

10. The process for cooling the turbine blade of claim 9, wherein the serpentine cooling circuit includes a first channel, at least one intermediate channel and a final channel, wherein the final channel includes an outer end adjacent to the tip cap where the cooling air is passed from the serpentine cooling circuit to the axial tip cooling circuit.

11. The process for cooling the turbine blade of claim 10, wherein cooling air from the serpentine cooling circuit passes along an inner surface of the tip cap, within the axial tip cooling circuit, from a forward location adjacent to the leading edge cooling circuit to a rearward location where it exits the airfoil adjacent to the trailing edge of the airfoil.

12. The process for cooling the turbine blade of claim 11, wherein the portion of cooling air passing through the serpentine cooling circuit is supplied via the blade root to the first channel of the serpentine cooling circuit.

13. The process for cooling the turbine blade of claim 12, wherein an additional portion of the cooling air is supplied directly to the final channel of the serpentine cooling circuit via the blade root.

14. An air cooled turbine blade comprising:

an airfoil having a leading edge and a trailing edge, and a pressure side wall and a suction side wall, the pressure and suction side walls extend in a chordal direction between the leading and trailing edges and extend spanwise between a blade root and a tip of the airfoil;

a leading edge cooling circuit extending spanwise adjacent to the leading edge;

a trailing edge cooling circuit extending spanwise adjacent to the trailing edge;

a mid-section serpentine cooling circuit extending spanwise and located between the leading edge cooling circuit and the trailing edge cooling circuit for channeling air in a forward direction extending from the trailing edge toward the leading edge, the serpentine cooling circuit including a first channel and a final channel, the first channel receiving cooling air from a first channel root passage;

an axial tip cooling circuit extending in the chordal direction and located between a tip cap and the serpentine cooling circuit at an outer end of the first channel, the axial tip cooling circuit having a forward end receiving cooling air from the final channel of the serpentine cooling circuit and discharging the cooling air adjacent to the trailing edge, wherein the axial tip cooling circuit is defined as a continuous cavity extending from the pressure side wall to the suction side wall between the tip cap and a cavity floor extending in an aft direction from the forward end of the axial tip cooling circuit to a location adjacent to the trailing edge;

wherein pressure and suction wall corners are defined within the axial tip cooling circuit at junctions of an inner tip cap surface with the respective pressure and suction side walls, and the tip cap is defined by opposing side portions extending inwardly from the pressure and suction wall corners toward the cavity floor, the opposing side portions each comprising a continuous radial inward angling to form a junction of the opposing side portions at a chordal center of the airfoil, wherein the axial tip cooling circuit has a minimum dimension in the spanwise direction at the chordal center of the airfoil, the tip cap further comprising a squealer rail extending radially outward from a junction of an outer tip cap surface with the pressure and suction side wall, wherein the squealer rail extends chordally from the leading edge to the trailing edge, the tip cap being recessed relative to the squealer rail to define a squealer tip cavity; and rib-like turbulators extending from inner surfaces of the pressure and suction side walls within the axial tip cooling circuit, the turbulators angled radially outward in the spanwise and aft directions, with respect to the cavity floor, to create a flow of the cooling air in the axial tip cooling circuit radially outward to the pressure and suction wall corners at the tip cap.

* * * * *